United States Patent [19]

Takase et al.

[11] Patent Number: 4,572,178

[45] Date of Patent: Feb. 25, 1986

[54] EMERGENCY MASK

[75] Inventors: Tsuneyoshi Takase; Yoriyuki Hayashi, both of Shimonoseki, Japan

[73] Assignee: Toyo CCI Kabushiki Kaisha, Tokyo, Japan

[21] Appl. No.: 594,972

[22] Filed: Mar. 27, 1984

[30] Foreign Application Priority Data

| | | | |
|---|---|---|---|
| Apr. 1, 1983 | [JP] | Japan | 58-46741[U] |
| Apr. 1, 1983 | [JP] | Japan | 58-46742[U] |
| Apr. 1, 1983 | [JP] | Japan | 58-46745[U] |

[51] Int. Cl.[4] ..... A62B 7/10

[52] U.S. Cl. ..... 128/205.27; 128/201.25; 55/316

[58] Field of Search ..... 55/318, 316; 128/201.25, 206.12, 206.17, 206.28, 207.11, 225.27, 201.23, 201.29, 205.29, 206.13, 206.15, 206.16; 502/324

[56] References Cited

U.S. PATENT DOCUMENTS

| | | | |
|---|---|---|---|
| 2,838,462 | 6/1958 | Pease | 502/325 |
| 3,072,119 | 1/1963 | Matheson | 128/206.17 |
| 3,216,415 | 11/1965 | Littleton | 128/206.17 |
| 3,562,813 | 2/1971 | Origer | 128/201.23 |
| 3,910,252 | 10/1975 | Richard | 55/316 |
| 3,925,248 | 12/1975 | Moroni | 55/318 |
| 4,099,526 | 7/1978 | Mascher | 128/205.29 |

FOREIGN PATENT DOCUMENTS

| | | | |
|---|---|---|---|
| 510491 | 8/1939 | United Kingdom | 128/201.25 |

*Primary Examiner*—Kyle L. Howell
*Assistant Examiner*—Daniel Haneiwich
*Attorney, Agent, or Firm*—Spencer & Frank

[57] ABSTRACT

The disclosed emergency mask has an air-purifying canister containing a combination of a smoke-filter, a desiccant, an adsorbent, and hopkalite catalyzer, so as to remove noxious gas generated during fire.

17 Claims, 6 Drawing Figures

EMERGENCY MASK

BACKGROUND OF THE INVENTION

1. Field of the Invention

This invention relates to an emergency mask, and more particularly to a hooded emergency mask which detachably holds a canister containing air-purifying antidote.

2. Description of the Prior Art

As to the performance of emergency masks for use in case of fire and the like, the importance of the ability to remove carbon monoxide has been increasing these years, in addition to the ability to provide protection against black smoke and white smoke. Further, it is also desirable for emergency masks to have ability to remove various noxious gases generated during fire, such as cyanic acid, hydrogen chloride gas, chlorine gas, ammonia, benzene, acrolein and other aldehydes, nitrogen oxides, and the like. Various kinds of emergency masks have been proposed to cope with the noxious gas. For instance, emergency masks capable of detachably holding canisters, loaded with antidote have been developed.

However, emergency masks of the prior art have a shortcoming in that, when thorough removal of noxious gases such as carbon monoxide is required in addition to the removal of smoke, the canister inevitably becomes bulky, so that the emergency masks become hard to carry, especially in case of hooded emergency masks.

SUMMARY OF THE INVENTION

Therefore, an object of the present invention is to obviate the above-mentioned shortcoming of the prior art by providing an improved emergency mask which can remove the above-mentioned variety of noxious gases while maintaining the ability of providing protection against white smoke and black smoke.

Another object of the invention is to provide an emergency mask which fulfils the above-mentioned requirements while effectively removing smoke with only a small pressure loss therethrough.

A further object of the invention is to provide an economical and practical emergency mask which fulfils the above-mentioned requirements and yet has a small size particularly suitable for handy carriage.

To fulfil the above objects, a preferred embodiment of the present invention uses a canister containing antidote which consists of a combination of a smoke-filter, a desiccant, an adsorbent, and a catalyzer of the oxidation of carbon monoxide, such as a product sold under the trademark Hopcalite. In addition to the removal of black smoke and white smoke for protection against them, the canister to be used in the present invention can remove noxious gases generated during fire such as carbon monoxide, cyanic acid gas, hydrogen chloride gas, chlorine gas, ammonia, benzene, acrolein and other aldehydes, nitrogen oxides, and the like, for protection against such noxious gases.

The smoke filter to be used in the canister can be selected from those which are commonly used in conventional anti-smoke masks, such as woven fabric, nonwoven fabric, and the like.

In order to make the canister compact, it is preferable to use a powerful desiccant as far as possible, so that the desiccant to be used in the present invention is preferably selected from the group consisting of synthesized zeolite and silica gel.

For the adsorbent, activated carbon fiber sheet is most preferable, but the inventors also succeeded in getting satisfactory result by using granular activated carbon as the adsorbent.

Hopcalite catalyzer contains copper oxide and manganese dioxide as major active ingredients thereof. Although it is preferable to use the adsorbent with a specific area of about 180 $m^2/g$ or more, those having a specific surface area of about 140 $m^2/g$ also showed fairly good result.

As to the composition of Hopcalite catalyzer, cobalt oxide and expensive ingredients such as silver oxide are not always necessary, and a Hopcalite catalyzer having major ingredients of copper oxide and manganese dioxide alone, preferably more than 15% by weight but less than 30% by weight of copper oxide, is preferable.

BRIEF DESCRIPTION OF THE DRAWINGS

For a better understanding of the invention, reference is made to the accompanying drawings, in which.

Throughout different views of the drawings, 1 is a canister, 2 is a smoke-filter, 3 is a desiccant, 4 is an adsorbent, 5 is a catalyzer, 6 is a metallic screen, 10 is an emergency mask, 12 is a canister-holder, 13 is a nose cup or a mouth piece (to be referred to as "face piece" hereinafter), 14 is a hood, 15 is a transparent window, 16 is a fastening band, and A is the flowing direction of air being inspired.

DESCRIPTION OF THE PREFERRED EMBODIMENTS

Figure 3:
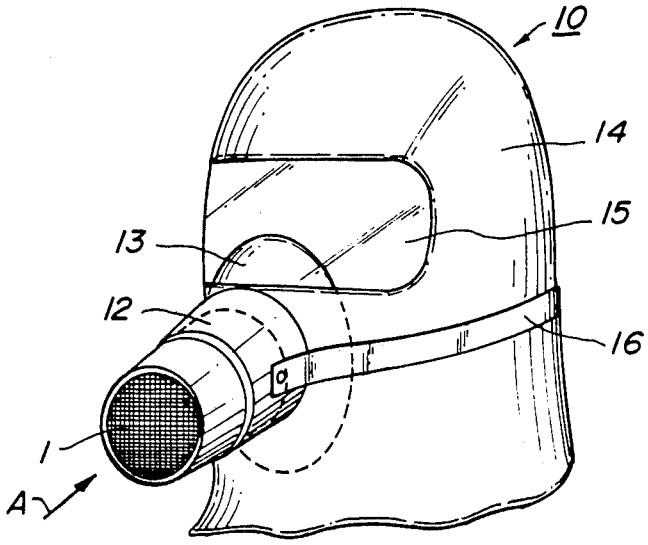
FIG. 3 PRIOR ART
FIGS. 3 and 4 are schematic perspective views of emergency masks of the prior art.
Figure 4:
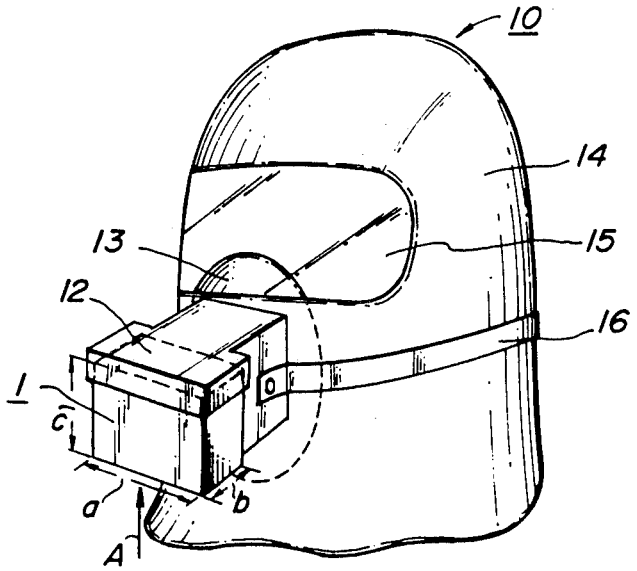
FIG. 4 PRIOR ART

Referring to FIG. 3 and FIG. 4, emergency masks of the prior art will be briefly reviewed. An emergency mask 10 has a canister-holder 12 holding a canister 1 containing an air-purifying agent, and a face piece 13 to be in contact with a respiratory face organ such as nose and/or mouth of a person who wears it (to be referred to as the "user", hereinafter), which face piece is secured to the canister-holder 12 so as to communicate therewith. The face piece 13 is for instance a nose cup covering the nose and mouth of the user or a mouth piece. A hool 14 is secured to the face piece 3 so as to cover at least the face of the user. The hood 14 may have a transparent window 15 and a fastening band 16.

Most of conventional emergency masks 10 use round canisters 1, as shown in FIG. 3. Rectangular canisters 1 have been used only rarely, and even when they are used, such rectangular canisters are never attached to the emergency mask 10 so as to extend forwardly but they are mounted on the front surface of a face piece 13 as flatly as possible for providing a wide field of view to the user. Thus, when being used in the past, the rectangular canister 1 had its long side extended laterally or substantially in parallel to the user's surface, as shown in FIG. 4. Such round canister and the flatly mounted rectangular canister 1 have a shortcoming in that they tend to make the emergency masks 10 bulky and hard to carry.

To obviate the above-mentioned shortcoming, the inventors tried to minimize the lateral width (a) of the cross-section of the canister 1. Through a number of studies and experiments, the inventors have succeeded in minimizing the width (a) by making both the length (b) of the cross-section and the height (c) of the canister 1 as large as possible; namely, by making the length (b) larger than about 1.15 times the width (a) and the height (c) larger than about 1 time the width (a).

In an emergency mask of the invention, a canister 1 is held by a canister-holder 12 so as to extend more in the vertical direction and in the forward direction away from a face piece 13, such as a nose cup or a mouth piece, than in the lateral direction in parallel to said face piece 13.

Figure 5:
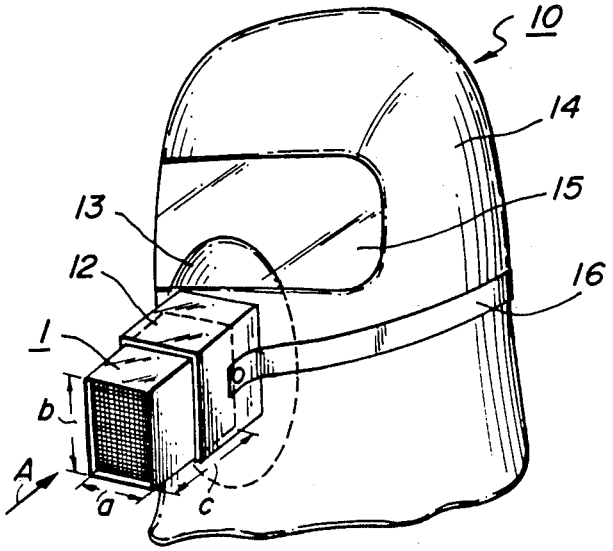
FIG. 5 is a schematic perspective view of an emergency mask according to the present invention.

FIG. 5 shows an emergency mask according to the present invention, in which the intake air inspired by the user comes from the straight forward direction as shown by the arrow A. The canister 1 is held by a canister-holder 12 which is connected to a face piece 13, which can be a nose cup or a mouth piece. Of the width (a), the length (b) and the height (c) of the canister 1, the length (b) and the height (c) should preferably be as large as possible, provided that they do not interfere with the field of view of the user. In addition, the canister-holder 12 preferably has a passage to the face piece 13 which has substantially the same cross-section as that of the canister 1 in shape and dimension. The emergency mask of the invention thus formed can be packed in a very small carrier bag of compact and thin form.

Figure 6:
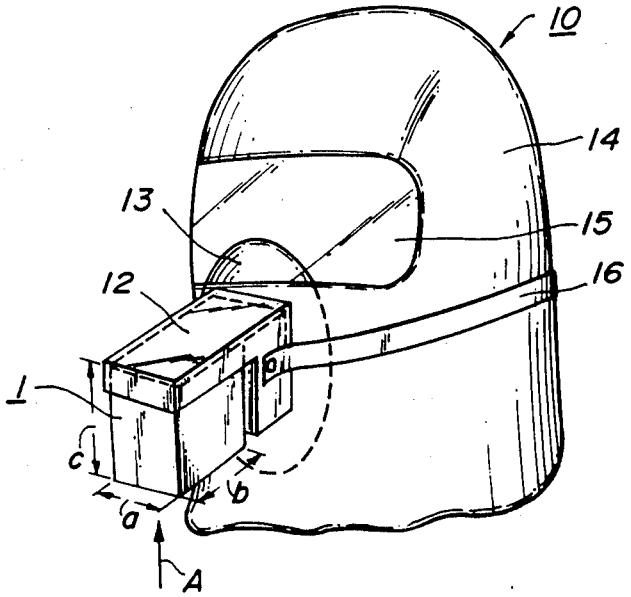
FIG. 6 is a schematic perspective view of another embodiment of the emergency mask according to the present invention.

FIG. 6 shows another embodiment of the invention in which the intake air inspired by the user enters the canister 1 in an upward direction from below, as shown by the arrow A of the figure.

Figure 1:
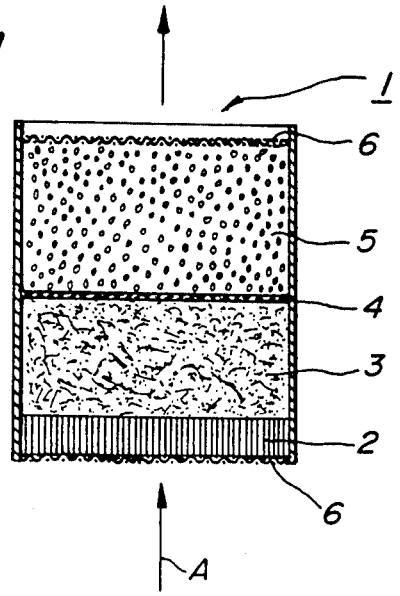
FIG. 1 is a schematic sectional view of the essential portion of a canister to be used in the present invention.

In arranging the contents of the canister 1 to be used in the present invention, a smoke-filter 2 may be placed at the very front or at an intake hole thereof, as practiced in the prior art. In this case, the chemicals and other contents may be arranged in the order of, for instance, the smoke-filter 2, a desiccant 3, an adsorbent 4, and a Hopkalite catalyzer 5, as shown in FIG. 1. Metallic screens 6 may be placed before the smoke-filter 2 and after the catalyzer 5.

However, the inventors have noticed that it is more preferable to place the desiccant 3 at the very front end or at the intake hole for the gas being inspired by the user i.e. to place the smoke-filter 2 behind the desiccant 3 but before the catalyzer 5. In this case, the ingredients of the canister 1 are arranged in a different order from that of conventional canisters; namely, starting from the intake hole for gas, in the order of the desiccant 3, the smoke-filter 2, chemicals, the adsorbent 4, and the catalyzer 5, as shown in FIG. 2.

Figure 2:
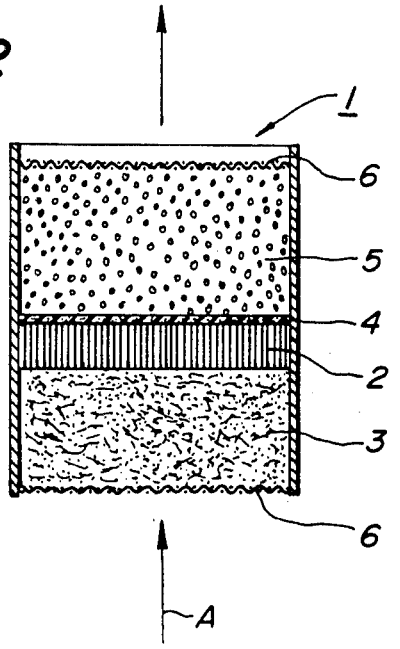
FIG. 2 is a schematic sectional view similar to FIG. 1, showing another embodiment of the canister.

With the order of disposing the ingredients as shown in FIG. 2, the desiccant 3 placed at the front end, or at the intake hole for gas, acts to remove most of the dampness and comparatively large black smoke particles in the gas being inspired. Thus, the duty of the smoke-filter 2 disposed behind the desiccant 3 becomes only to remove fine particles of dry black smoke and dry white smoke. Accordingly, the pressure loss in the canister 1 can be minimized.

Although the emergency mask 10 can fully perform its duty without any hood 14, it is more desirable to provide a hood 14 because it protects the head and shoulders of the user. If used, the hood 14 is preferably made of a heat-resistive and heat-reflective material. The illustrated hood 14 has a window 15 with a heat-resistive transparent plastics sheet, which sheet is preferably coated with a heat-reflective metallic thin film deposited thereon.

The face piece 13, such as a nose cup or a mouth piece, should be airtightly coupled to the canister-holder 12. If the hood 14 is used, the face piece 13 should be airtightly secured to the hood 14 too, so as to prevent bypass of the outside gas into the inside of the hood 14 without passing the canister 1. The canister-holder 12 may be integrally formed with the face piece 13.

The inventors found that the shape and size of the canister 1 is the major factor which governs the size and shape of a carrier bag for the emergency mask 10, especially in the case of the emergency mask 10 with the hood 14. As a result of efforts for improving the storage space factor by packing the emergency mask 10 in a compact thin form, the following dimension of the canister 1 was found preferable; namely, the cross-section of the canister 1 taken at right angles to its height (c) in the direction of air flow therethrough being either rectangular with its length (b) being larger than about 1.15 times its width (a) or elliptic with its major axis (m) being larger than about 1.15 times its minor axis (n), while making the height (c) larger than the width (a).

The canister 1 is preferably connected to the canister-holder 12 so as to extend more in the vertical direction and in the forward direction away from the face piece 13, e.g., a nose cup or mouth piece, than in the lateral direction in parallel to the face piece 13. The length (b) of the rectangular cross-section of the canister 1 is more preferably larger than about 1.2 times its width (a).

A feature of the emergency mask of the invention is that it has a broad field of view. As another feature, it can be packed in a carrier bag, such as a rectangular flat carrier bag made of cloth or the like, with a thickness which is substantially the same as or slightly larger than the width (a) of its canister. Conventional emergency masks cannot be folded in a flat form but only in a ball-like shape with a comparatively large diameter, so that the conventional emergency mask was difficult to put in an attache case or the like. On the other hand, the emergency mask of the invention can be packed in a thin small compact form, so that it can be easily placed in a hand bag, an attache case, or the like. Thus, the emergency mask of the invention is handy and very easy to carry. Being folded in a substantially rectangular form, the emergency mask of the invention eliminates dead space when placed in the attache case, stored in bulk on a shelf, or shipped in bulk in a box. With the ball-like package of the conventional emergency mask, considerable dead space is inevitable. Thus, with the emergency mask of the invention, storage spaces can be utilized effectively and economically.

A further feature of the emergency mask of the invention is in that the user can put it on his face very quickly.

The invention will now be described in further detail by referring to examples.

EXAMPLE 1

A canister for the emergency mask was prepared by stuffing in successive layers, a nonwoven fabric smoke-filter, 55 g of zeolite desiccant of 7–12 mesh made by ZEOCHEM of the U.S.A., one sheet of activated carbon fiber, and 79 g of Hopcalite catalyzer of copper-manganese system (8–20 mesh, copper oxide CuO 22%, manganese dioxide $MnO_2$ 78%, a specific surface area of 217 $m^2/g$) into a can, while placing suitable regular metallic screens at the front and rear ends of the canister. The canister had a rectangular cross-section having a width (a) of 54 mm and a length (b) of 65 mm (b being about 1.2a), and a height (c) of about 87 mm.

The canister thus prepared was mounted on a device for testing the carbon monoxide (CO) removal, and air containing 5,000 ppm of carbon monoxide (CO) with a relative humidity of 65% at 24° C. was blown into the canister through its intake hole at a rate of 30 l/min. The concentration of carbon monoxide (CO) in the gas from the discharge hole of the canister was measured 20 minutes after the start of the test, and it was less than 350 ppm.

EXAMPLE 2

A canister was prepared in the same manner as that of Example 1. A test of hydrogen cyanide (HCN) removal was carried out under the same conditions as those of Example 1 except that instead of 5,000 ppm of carbon monoxide (CO), 350 mm of hydrogen cyanide (HCN) was used. The concentration of hydrogen cyanide (HCN) in the gas from the discharge hole of the canister was less than 5 ppm at 20 minutes after the start of the test, 6 ppm after 30 minutes, 15 ppm after 40 minutes, and 24 ppm after 50 minutes.

EXAMPLE 3

A canister was prepared in the same manner as that of Example 1. A test of the removal of carbon monoxide (CO) and hydrogen chloride (HCl) was carried out under the conditions that the inlet air before blowing into the canister contained 5,000 ppm of carbon monoxide (CO) and 575 ppm of hydrogen chloride (HCl) and had a relative humidity of 65%. The inlet air was blown into the canister at a rate of 30 l/min at 20° C. instead of 24° C. of Example 1. The gas from the discharge hole of the canister had a concentration of hydrogen chloride (HCl) of less than 2 ppm and a concentration of carbon monoxide (CO) of 300 ppm at 20 minutes after the start of the test.

EXAMPLE 4

A canister was prepared in the same manner as that of Example 1. Individual tests were carried out on the thus prepared canister for the removals of ammonia, benzene, formaldehyde, and nitrogen dioxide, respectively. The inlet gas was blown into the canister at 20° C. at a rate of 20 l/min. The result was as shown in Table 1.

TABLE 1

| | Concentration in inlet air (ppm) | Concentration in discharge gas (ppm) | |
|---|---|---|---|
| Ammonia | 1,000 | 80 | average over 20–40 minutes from test start |
| Benzene | 200 | below 5 | 25 minutes from test start |
| Formaldehyde | 250 | 1 | average over 68 minutes from test start |
| $NO_2$ | 200–250 | 0 | 30 minutes from test start |
| $NO_2$ | 200–250 | 22.5 | 120 minutes from test start |

EXAMPLE 5

A canister was prepared in the same manner as that of Example 1, so that the contents of the canister were disposed in the order of the smoke-filter, the desiccant, the adsorbent, and the catalyzer, as seen from the intake hole of the canister. The following anti-smoke tests stipulated by the Fire Defense Board of the Japanese Government were carried out on the canister thus prepared.

TEST METHOD (a) White smoke tests: Wood baking smoke and carbon monoxide were collected in a smoke collecting box (about 2 $m^3$), and the concentration of smoke and carbon monoxide in a smoke-concentration meter at the inlet side were adjusted at 0.7±0.01/m (light extinction factor) and 2,500±250 ppm, respectively. The smoke thus adjusted was forced through the canister at a blowing rate of 30 l/min, and then the smoke concentration and the concentration of carbon monoxide and the gas passage resistance value were measured.

(b) Black smoke test: Tests similar to the foregoing paragraph (a) were carried out by using flamed fire smoke of foamed polystyrene, which smoke contained 2,500±250 ppm of carbon monoxide.

The results of the tests are shown in Table 2.

Since the allowable limit of the resistance for those tests is stipulated to be 50 mmAq, the black smoke tests were ended in 9 minutes when the resistance of 50 mmAq was indicated. This 9 minutes period is sufficient for the anti-smoke mask.

Both the outlet smoke concentration and the outlet carbon monoxide (CO) concentration proved to be approvable without any difficulty.

TABLE 2

| Items | Acceptable value for approval | Test result White smoke | Test result Black smoke | Approved or not |
|---|---|---|---|---|
| Room temperature (°C.) | | 24 | 24 | |
| Room relative humidity (%) | | 65 | 65 | |
| Resistance at start of test (mmAq) | | 10 | 10 | |
| Test duration (min) | above 3 | 15 | 9 | Approved |
| Resistance at end of test (mmAq) | below 50 | 18 | 50 | Approved |
| Outlet smoke concentration at test end ($m^{-1}$) | below 0.1 | 0.05 | 0.01 | Approved |
| Outlet CO concentration at test end (ppm) | below 350 | 35 | 0 | Approved |

EXAMPLE 6

A canister was prepared in a manner similar to that of Example 5, except that the order of disposing the smoke-filter and the desiccant was reversed; namely, the contents of the canister were arranged in the order of the desiccant, the smoke-filter, the adsorbent, and the catalyzer, as seen from the intake hole of the canister. The anti-smoke tests were carried out on this canister in the same manner as that of Example 5. The result is shown in Table 3.

The result of white smoke test was very good. In the black smoke test, the resistance became 50 mmAq in 17 minutes, which meant that the canister of this Example worked about twice as long, in comparison with 9 minutes in Example 5. Thus, the advantage of placing the drier before the smoke-filter was well demonstrated.

TABLE 3

| Items | Acceptable value for approval | Test result White smoke | Test result Black smoke | Approved or not |
|---|---|---|---|---|
| Room temperature (°C.) | | 24 | 24 | |
| Room relative humidity (%) | | 65 | 65 | |
| Resistance at start of test (mmAq) | | 10 | 10 | |
| Test duration (min) | above 3 | 20 | 17 | Approved |
| Resistance at end of test (mmAq) | below 50 | 28 | 50 | Approved |
| Outlet smoke concentration at test end ($m^{-1}$) | below 0.1 | 0.05 | 0.01 | Approved |
| Outlet CO concentration at test end (ppm) | below 350 | 50 | 0 | Approved |

EXAMPLE 7

An emergency mask having a hood and a canister adapted to inspire air horizontally, as shown in FIG. 5, was prepared by using a canister which had a width (a) of 47 mm, a length (b) of 75 mm (b being about 1.60a), and a height (c) of 87 mm. The emergency mask was folded and packed in a carrier bag made of fabric, and the emergency mask was found to be freely packed in a carrier bag having a thickness of 45 mm, a width of 120 mm, and a length of 230 mm. The thus packed carrier bag could be easily placed in an attache case and the like.

EXAMPLE 8

An emergency mask having a hood and a canister adapted to inspire air vertically, as shown in FIG. 6, was prepared by using a canister of the same size as that of Example 7. The emergency mask was folded and packed in a carrier bag made of fabric, and the emergency mask was found to be freely packed in a carried bag having a thickness of 45 mm, a width of 140 mm, and a length of 180 mm. The thus packed carrier bag could be easily placed in an attache case and the like.

Reference 1

A cylindrical canister with the same height and the same cross-sectional area as those of the canister of Example 5 was prepared; namely, a cylindrical canister with a cross-sectional diameter of 67 mm and a height of 87 mm. An emergency mask having a hood and a canister adapted to inspire air horizontally, as shown in FIG. 3, was prepared by using the above-mentioned cylindrical canister. The emergency mask was folded and packed in a carrier bag made of fabric, and the emergency mask could be packed in a carrier bag having a thickness of 65 mm, a width of 120 mm, and a length of 150 mm. However, the thus packed carrier bag was hard to place in an attache case.

Reference 2

An emergency mask having a hold and a canister adapted to receive intake air vertically, as shown in FIG. 4, was prepared by using a canister with the same size as that of Example 7. In Example 7, the canister extended forwardly in the length direction of the canister, but in this Reference, the canister extended forwardly in the width direction while keeping the length direction of the canister in parallel to the user's face. The emergency mask was folded and packed in a carrier bag made of fabric, and the emergency mask was found to be packed in a rolled form within a carrier bag having a thickness of 75 mm, a width of 110 mm, and a length of 135 mm. However, the thus packed carrier bag could not be placed in an attache case.

Although the invention has been described with a certain degree of particularity, it is understood that the present disclosure has been made only by way of example, and that numerous changes in details of construction and the combination and arrangement of parts may be resorted to without departing from the scope of the invention as hereinafter claimed.

What is claimed is:

1. A canister for an emergency mask, the mask having a face piece adapted to come in contact with a respiratory face organ of a user, and a canister-holder airtightly holding the canister and airtightly coupled with the face piece so as to communicate therewith, said canister having a gas inlet opening and a gas flow passage extending through said canister from said gas inlet opening, and said canister containing a plurality of air-purifying agents in the form of respective layers each extending across said gas flow passage, said air-purifying agents being composed of, in succession along said passage and starting from said opening, in the order recited, a desiccant, a smoke-filter, an adsorbent, and a catalyzer of the oxidation of carbon monoxide, whereby said agents remove black smoke, white smoke, carbon monoxide, hydrogen chloride gas, chlorine gas, cyanic acid, ammonia, benzene, acrolein and other aldehydes, nitrogen oxides, and other noxious gases generated during fire.

2. A canister for an emergency mask as set forth in claim 1, wherein said desiccant in said canister is selected from the group consisting of zeolite and silica gel.

3. A canister for an emergency mask as set forth in claim 1, wherein said adsorbent is selected from the group consisting of activated carbon filter sheet and granular activated carbon.

4. A canister for an emergency mask as set forth in claim 1, wherein said catalyzer has a specific surface area of larger than about 140 $m^2/g$.

5. A canister for an emergency mask as set forth in claim 1, wherein said catalyzer has a specific surface area of larger than about 180 $m^2/g$.

6. A canister for an emergency mask as set forth in claim 1, wherein said catalyzer contains major ingredients of copper oxide and manganese dioxide alone.

7. A canister for an emergency mask as set forth in claim 1, wherein said catalyzer contains about 15% by weight to about 30% by weight of copper oxide.

8. An emergency mask comprising a face piece adapted to come in contact with a respiratory face organ of a user; a canister-holder airtightly coupled with said face piece so as to communicate therewith; and a canister airtightly held by said canister-holder, said canister having a gas inlet opening and a gas flow passage extending through said canister from said gas inlet opening, and said canister containing a plurality of air-purifying agents in the form of respective layers each extending across said gas flow passage, said air-purifying agent being composed of, in succession along said passage and starting from said opening, in the order recited, a desiccant, a smoke filter, an adsorbent, and a catalyzer of the oxidation of carbon monoxide, whereby said agents remove black smoke, white smoke, carbon monoxide, cyanic acid, hydrogen chloride gas, chlorine gas, ammonia, benzene, acrolein and other aldehydes, nitrogen oxides, and other noxious gases generated during fire.

9. An emergency mask as set forth in claim 8, wherein said emergency mask further comprises a hood airtightly secured to said face piece and adapted to cover at least the face of the user.

10. An emergency mask as set forth in claim 9 wherein said hold is heat-resistive and heat-reflective.

11. An emergency mask as set forth in claim 9, wherein said hood has a transparent window having a heat-resistive plastics sheet with a thin coating of heat-reflective metal.

12. An emergency mask as set forth in claim 11, wherein said thin coating is evaporated on said transparent plastics sheet.

13. An emergency mask as set forth in claim 8, wherein said canister has a rectangular cross-section at right angles to height (c) taken in flowing direction of air therethrough, said rectangular cross-section having a length (b) which is longer than 1.15 times a width (a) thereof ($b > 1.15a$), said height (c) being not shorter than said width (a) thereof, said canister being held by said canister-holder so as to extend more in vertical direction and forward direction away from said face piece than in lateral direction in parallel to said face piece.

14. An emergency mask as set forth in claim 13, wherein said length (b) of said rectangular cross-section is longer than 1.2 times the width (a) thereof ($b > 1.2a$).

15. An emergency mask as set forth in claim 3, in combination with a handy carrier bag into which said mask can be packed.

16. An emergency mask as set forth in claim 8, wherein said canister has an elliptic cross-section at right angles to height (c) taken in flowing direction of air therethrough, said elliptic cross-section having a major axis (m) which is longer than 1.15 times of a minor axis (n) thereof ($m > 1.15n$), said height (c) being not shorter than said minor axis (n) thereof, said canister being held by said canister-holder so as to extend more in vertical direction and in forward direction away from said face piece than in lateral direction in parallel to said face piece.

17. An emergency mask as set forth in claim 8, wherein said canister holder has a passage toward said face piece, said passage having a cross-section which has substantially the same size and dimension as those of said canister held thereby.

* * * * *